US006742202B2

(12) United States Patent
Jones

(10) Patent No.: US 6,742,202 B2
(45) Date of Patent: Jun. 1, 2004

(54) SUPPORT SYSTEM HAVING TELESCOPING COLUMNS

(76) Inventor: B. Thomas Jones, 6001 Skillman, #176, Dallas, TX (US) 75240

( * ) Notice: Subject to any disclaimer, the term of this patent is extended or adjusted under 35 U.S.C. 154(b) by 91 days.

(21) Appl. No.: 10/095,396

(22) Filed: Mar. 12, 2002

(65) Prior Publication Data

US 2003/0172456 A1 Sep. 18, 2003

(51) Int. Cl.[7] ..... A47C 23/02

(52) U.S. Cl. ..... 5/263; 5/719; 5/720; 5/722; 5/727

(58) Field of Search ..... 5/716, 720, 719, 5/256, 263, 253, 722, 727, 400; 267/166; 248/605, 606, 622, 623; 297/344.18, 325

(56) References Cited

U.S. PATENT DOCUMENTS

| | | | | |
|---|---|---|---|---|
| 92,396 A | | 7/1869 | Sulzbacher | |
| 178,770 A | | 6/1876 | Hegedüs | |
| 1,343,620 A | | 6/1920 | Gainer | |
| 1,928,526 A | | 9/1933 | Fellabaum | 267/33 |
| 2,661,486 A | | 12/1953 | Roher | 5/351 |
| 2,992,443 A | | 7/1961 | Winikoff | 5/351 |
| 3,251,076 A | | 5/1966 | Burke | 5/351 |
| 3,263,247 A | | 8/1966 | Knittel et al. | 5/353 |
| 3,280,410 A | | 10/1966 | Propst et al. | 5/353 |
| 3,572,621 A | * | 3/1971 | Whitten et al. | 248/548 |
| 4,122,568 A | | 10/1978 | Bastos et al. | 5/345 R |
| 4,654,989 A | | 4/1987 | Fleming | 40/427 |
| 4,842,273 A | * | 6/1989 | Schmeiss | 482/49 |
| 4,956,884 A | | 9/1990 | Hwang | 5/246 |
| 5,471,688 A | | 12/1995 | Cavazos | 5/251 |
| 5,622,090 A | | 4/1997 | Marks | 81/185 |
| 6,243,900 B1 | | 6/2001 | Gladney et al. | 5/720 |

FOREIGN PATENT DOCUMENTS

RU 2047037 C1 * 10/1995 ..... F16L/3/20

* cited by examiner

*Primary Examiner*—Teri Pham Luu
(74) *Attorney, Agent, or Firm*—John A. Thomas

(57) ABSTRACT

A support system has an array of telescoping columns that are each extended by a means such as a spring. The ends of the extended columns define a plane of support for a body resting on the array of columns. The columns move perpendicular to the plane of support, and independently, in response to the weight of a body resting upon them. The means for keeping the columns extended may be passive or active, and the columns may be moved independently by actuators connected to them. The columns may be assembled into modules, which can in turn be assembled into support systems of arbitrary size and shape.

17 Claims, 7 Drawing Sheets

Fig. 1
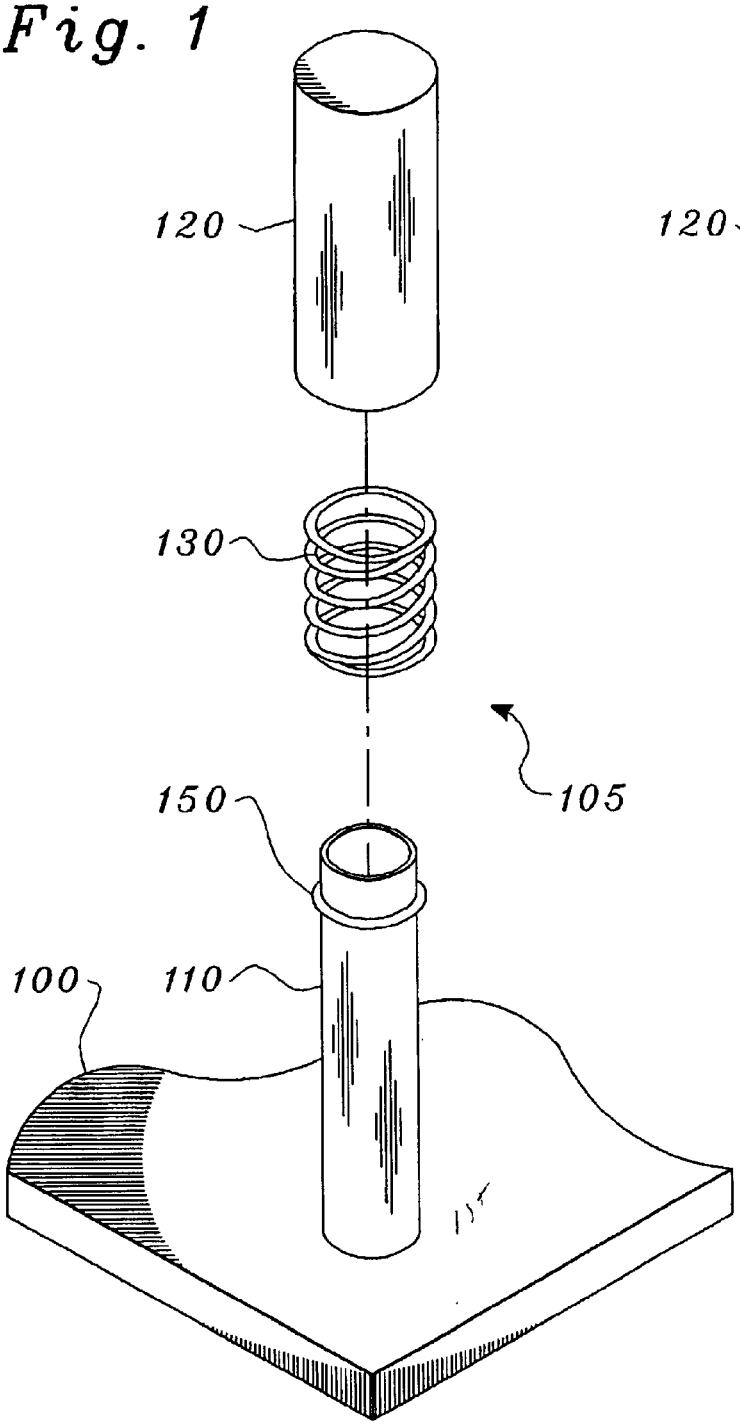
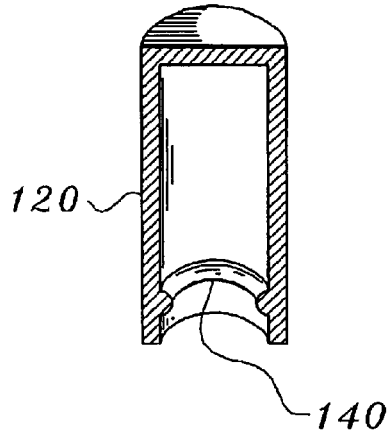
Fig. 2

SUPPORT SYSTEM HAVING TELESCOPING COLUMNS

FIELD OF THE INVENTION

This invention relates to resilient planar support systems, in particular to support systems for mattresses.

BACKGROUND

Spring supports for mattresses commonly have coil springs with their upper and lower terminations secured to the respective upper and lower terminations of adjacent springs. The terminations of the springs thus define flexible upper and lower surfaces This connection of adjacent spring terminations causes undesirable effects, however.

One undesirable effect is the "hammock effect." That is, the plane of support slopes toward the center of applied pressure. Essentially, this creates a lack of conformity to the body resting on the upper plane, or surface, of the mattress, similar to the action of a trampoline. A trampoline will depress in response to an applied force, but it cannot conform to the contours of the body applying the force, such as a human body.

Traditional mattresses or support systems have other disadvantages resulting from this common construction. For example, they lack the ability to provide adequate support in areas between the points of greatest curvature of a body resting upon them. This can cause a sleeper to have a poor sleeping posture and inhibit blood circulation at the points of greatest curvature, such as hips, elbows, and buttocks. Such typical mattresses are bulky to ship and store, and their size cannot be changed once manufactured.

Typical prior art patents illustrate the common construction of mattresses. Examples are Hegedus, U.S. Pat. No. 178,770, and Roher, U.S. Pat. No. 2,661,486. These patents disclose mattresses having springs connected at their upper and lower terminations. Propst, et al., U.S. Pat. No. 3,280,410, disclose the use of bellows springs which are not connected to adjacent springs at their upper terminations. However, the bellows springs lack lateral stability, unless lateral stability is provided by a cover which is to be "flexible, but not stretchable." This feature creates the same hammock effect noted above for the common construction. Knittel, et al., U.S. Pat. No. 3,263,247 also discloses bellows springs where lateral stability is sought by the abutment of blocks integral to the springs. The friction and binding so created limits the desired effect of independent spring movement.

The invention solves these problems by providing a support system that eliminates the hammock effect and gives adequate support to all contours of a body resting upon it. It adequately supports areas between points of greatest curvature on a body. The beneficial effect to human sleepers is good sleeping posture, good blood circulation at the hips, elbows, and buttocks, and a deep cushioning effect. Also, the preferred embodiment is modular, so that mattresses may be constructed of almost arbitrary size, as well as taken apart for easy cleaning.

SUMMARY

The support system of the preferred embodiment comprises a plurality of columns. The columns have first and second ends; the columns further comprise at least two telescoping sections. There is at least one means for extension disposed between the telescoping sections. This means for extension urges the first and second ends of the columns apart to the limit of extension for the means for extension.

The support system has a base; the columns are connected to the base at their first ends; and, the second ends of the columns define a plane of support when the means for extension are at the limit of their extension. The second ends of the columns are moveable perpendicular to the plane of support independently of one another.

In the preferred embodiment, the telescoping columns may be assembled into arrays in separate modules. These modules may be assembled to form larger support systems of various shapes.

DESCRIPTION OF THE DRAWINGS

FIG. 1 is an exploded perspective view of the telescoping column element of the preferred embodiment.

FIG. 2 is a cross-section of the upper section of the column in FIG. 1.

Figure 3:
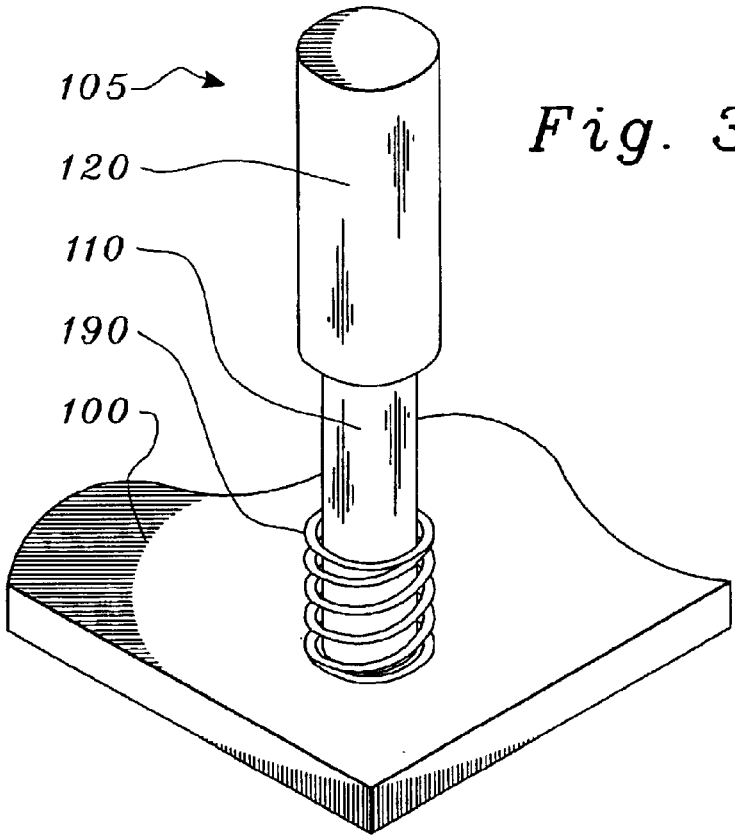
FIG. 3 is a perspective view of the assembled telescoping column.

A table of reference numerals follows:

| Number | Description |
|---|---|
| 100 | base |
| 105 | telescoping column |
| 110 | lower column section |
| 120 | upper column section |
| 130 | spring |
| 140 | upper annular boss |
| 150 | lower annular boss |
| 160 | external spring |
| 170 | push rod |
| 180 | thrust washer |
| 190 | auxiliary spring |
| 200 | mounting screw |
| 210 | limit nut |
| 220 | alternate upper section |
| 230 | alternate lower section |
| 240 | actuator rod |
| 250 | actuator |
| 260 | linear position transducer |
| 290 | module |
| 300 | frame (base) |
| 310 | guardrail |
| 320 | caster |
| 330 | bolt holes |
| 340 | alignment hole |
| 350 | guardrail mounting |
| 360 | base mounting plate |
| 370 | carry hole |

-continued

| Number | Description |
|---|---|
| 380 | base mounting hole |
| 390 | guardrail pins |
| 400 | adjacent modular bolt hole |
| 410 | cover |
| 420 | cushion |
| 430 | computer |
| 440 | servo amplifier |

DETAILED DESCRIPTION

The preferred embodiment of the invention is constructed in modular sections (290), with each module (290) having a plurality of telescoping columns (105). FIG. 1 shows an exploded view of a typical telescoping column (105) in the preferred embodiment. FIG. 2 shows a cross-section of the upper section (120) of the telescoping column (105).

The telescoping column (105) has an upper section (120) and a lower section (110), the lower section having an outside diameter smaller than the inside diameter of the upper section (120), so that the sections (110, 120) can slidably engage one another, as shown.

A means for extension, in this case a spring (130), occupies the upper section (120). The spring (130) has an outside diameter equal to the outside diameter of the lower section (110). Thus the spring (130) is contained within the upper section (120) and rests against the upper end of the lower section (110). The spring (130) is chosen so as to urge the upper section (120) and the lower section (110) apart and thus extend the telescoping column (105).

Other means for extension of the telescoping column (105) could be used. Equivalents include, but are not limited to, resilient substances such as rubber or plastic, balloons, hydraulic or pneumatic shock absorbers, or active means such as hydraulic, pneumatic, or electric actuators. Some such equivalents are discussed later in this disclosure.

Figure 4:
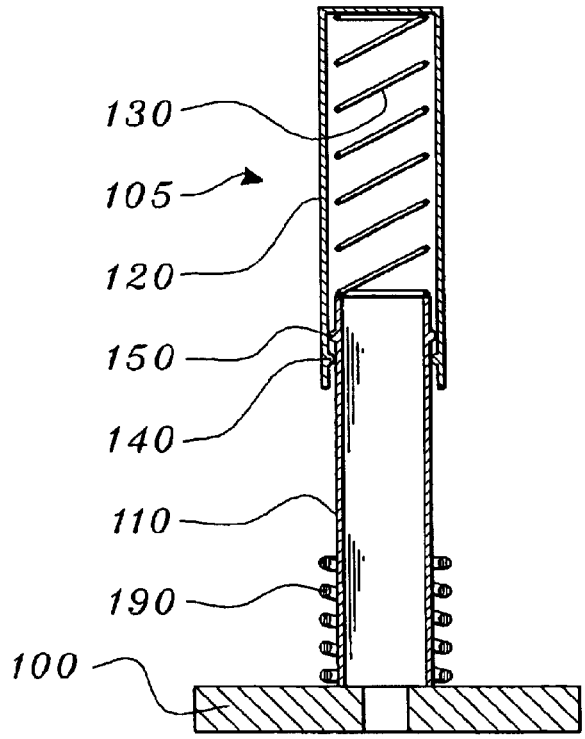
FIG. 4 is a cross-section of the telescoping column of FIG. 3.

In the preferred embodiment, the lower section (110) has an external annular boss (150), and the upper section (120) has an internal annular boss (140). These bosses (140, 150) cooperate with each other to prevent separation of the lower section (110) and the upper section (120) of the telescoping column (105). The axial width of the bosses (140, 150) may vary, but should be large enough to maintain the axial alignment of the upper section (120) and the lower section (110) and prevent their departure from axial alignment, particularly when the telescoping column (150) is fully extended. The material for the construction of the telescoping columns (105) is chosen to be rigid, but to have sufficient elasticity to allow the upper boss (140) to snap over the lower boss (150) when the telescoping column (105) is assembled, while allowing the sections (110, 120) to slide freely with respect to one another. Polyethylene or polycarbonate plastics are suitable. The springs (130) may be chosen to have the desired degree of resistance to compression when the columns (105) are subjected to a load. The springs (130) need not have the same elasticity, or spring constant. This factor may be varied to produce different support forces over a plane of support, as defined below. FIG. 3 shows the assembled column (105) and FIG. 4 is a cross-section of the assembled column (105), showing the column (105) attached to a base (100).

Figure 5:
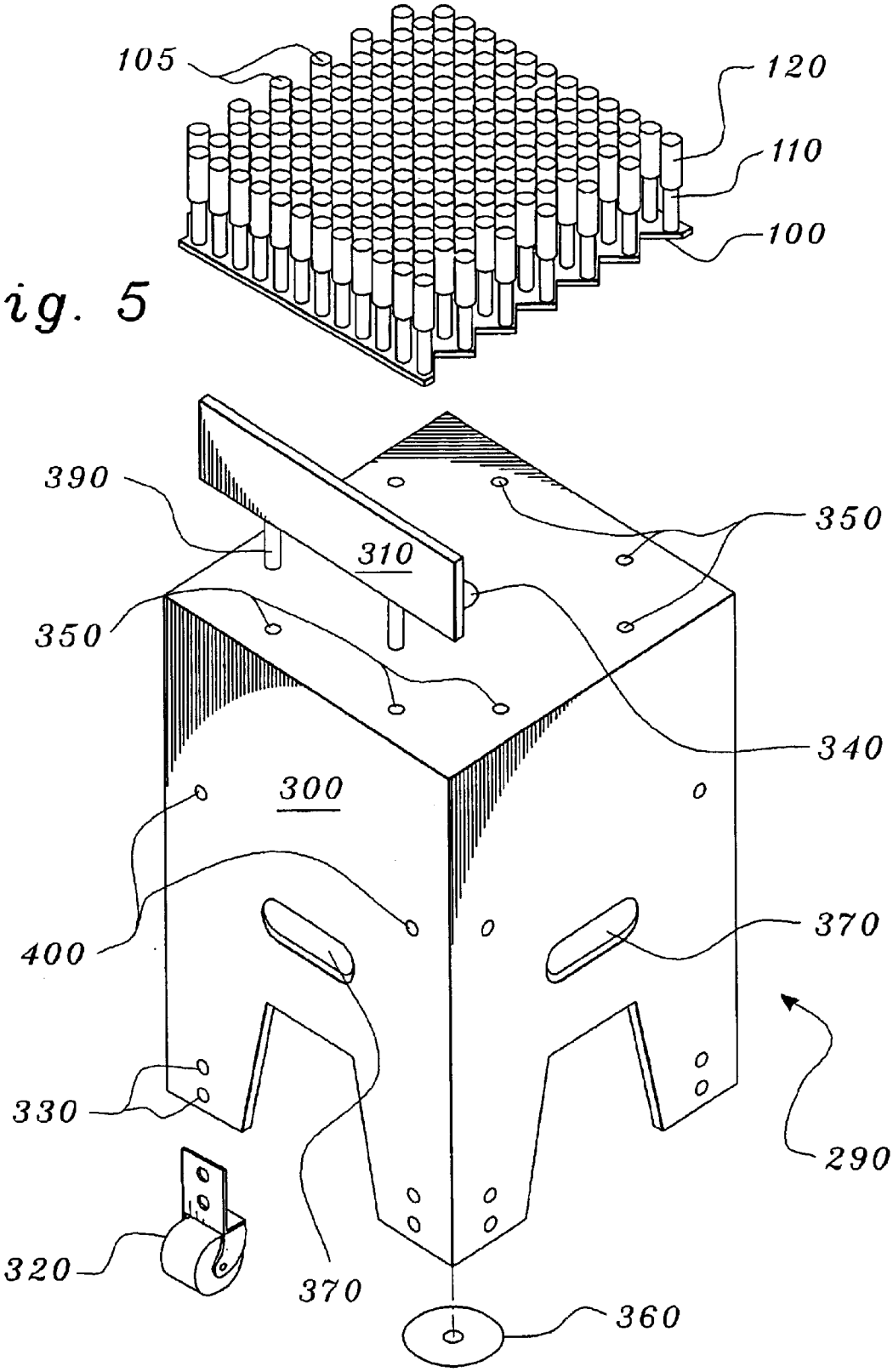
FIG. 5 is an exploded perspective view of one module of telescoping columns, for the preferred embodiment.

In the preferred embodiment, the telescoping columns (105) just described are mounted substantially perpendicular to a common base (100) in a closely-spaced array. A base (100) of such mounted columns (105) is then mounted in a frame (300), thus forming a module (290). An exploded view of one such module (290) is shown in FIG. 5. Preferably, the lower sections (110) of the telescoping columns (105) should be monolithic with the base (100), to provide adequate strength to sustain lateral forces and prevent loosening because of vibration. The lower sections (110), may, however, be connected to the base (100) by other means, such as gluing, welding, or bolting.

This closely-spaced array of telescoping columns (105) provides the ability of the system to conform to relatively short-radius curves, concave or convex with respect to the array of telescoping columns (105), because the columns (105) move independently of one another under the weight of a body resting upon them. For the closest possible spacing, the telescoping rods (105) should be mounted in staggered rows, rather than congruent rows, although this spacing requires one dimension of the finished array to be larger than the other by one-half column diameter. This effect may or may not be significant, depending on the diameter of the telescoping columns (105) and the size of the objects expected to be supported. In practice, for support of a human body, columns 24 mm (0.95 inch) in diameter are adequate. For support of a human body, a column (105) on-center spacing of 25 mm (1.0 inch) is adequate. Typical springs for a human-body support would be stainless steel or zinc-plated (to resist corrosion), having a diameter of 20 mm (0.77 inch), a length of 64 mm (2.5 inches), and a spring constant of 340 newtons/cm (30 lbs/inch). Of course, the invention may be embodied in arrays of telescoping columns (105) much smaller or much larger than those stated for supporting human bodies, and springs could be made of other materials having the desired properties, as is known in the art.

The reader will understand that the telescoping columns (105) need not all have the same means for extension; springs (130) of different strength, for example, may be used in different areas of the arrayed telescoping columns (105). Other variables which determine the response of the support system include: the diameter of the upper section (120), the travel distance of the upper section (120), and the spacing of the telescoping columns (105). The design of the preferred embodiment allows changing of any of the above variables, while holding the others constant, thus providing a variety of ways to produce the desired response of the telescoping column (105) to an applied load.

The assembled base (100) is preferably connected to the frame (300) by bolting it through a mounting plate (360) and an alignment hole (340) in the frame (300). The diameter of the mounting plate (360) is larger than that of the alignment hole (340) to allow the base (100) of one module (290) to be aligned with the base (100) of adjacent modules (290). The frame (300) has guard-rail mounting holes (350) for the selective mounting of guard rails (310) on those edges of a module (290) positioned at the edge of an assembled mattress. The guard rails (310) provide protection from externally imposed lateral stress. The guard rails (310) have pins (390) which slide into the guard-rail mounting holes (350).

Each module (290) may be provided with casters (320) to allow it to be easily moved. Generally, the casters (320) need only be mounted on the outside edges of the frames (300) when the modules (290) are assembled into a mattress. Bolt holes (330) are provided for mounting the casters (320). Carry holes (370) are also provided. The modules (290) are preferably bolted together though bolt holes (400) provided in the frames (300).

Figure 6:
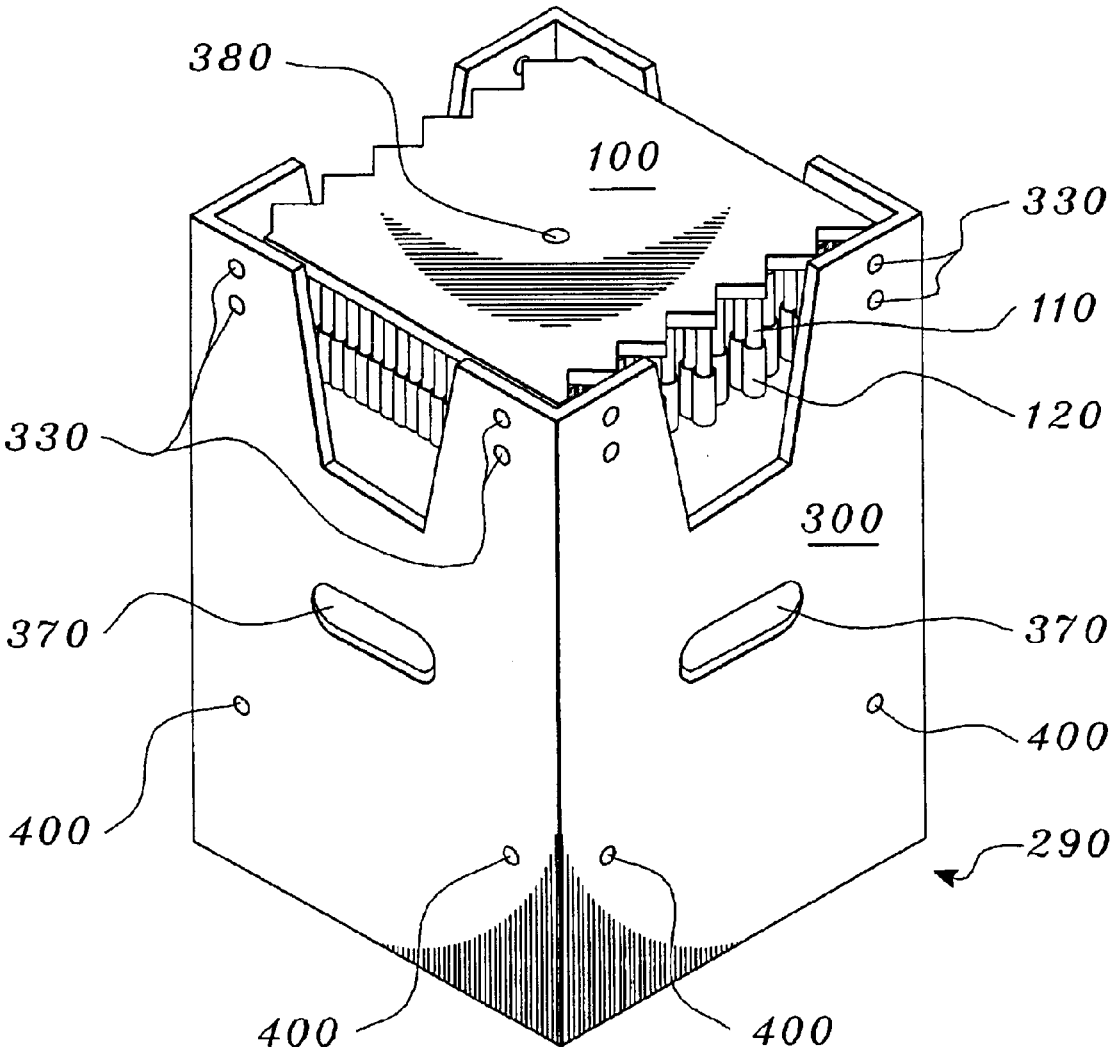
FIG. 6 is a perspective view of one module of the preferred embodiment, upside down, as it would be configured for shipment or storage.

FIG. 6 shows a view of a module (290), upside down from its operational position, with the base (100) fastened to the bottom of the frame (300). This configuration may be used for shipment or storage of individual modules.

Figure 7:
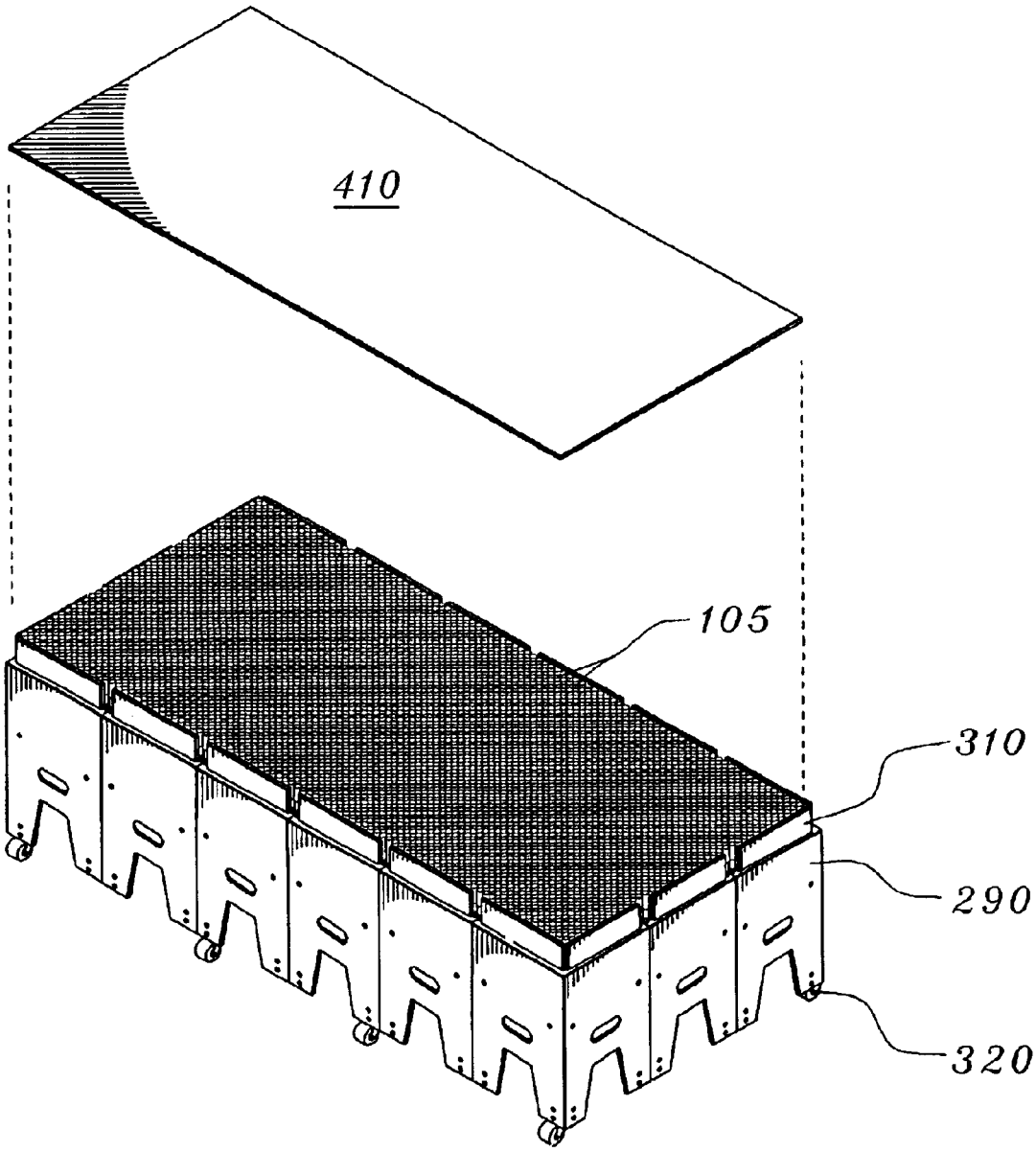
FIG. 7 is a perspective view of a mattress assembled from modules of the preferred embodiment.

FIG. 7 shows the assembled support system, comprised of modules (290) connected together to form a plane of support. The plane of support is defined by the extension of the telescoping columns (105). As a body rests on the support system, the plane of support is deformed in conformity with the shape of the body. In the preferred embodiment, for support of humans, the ends of the telescoping columns (105) are covered by a relatively thin cover (410), typically between 25 to 50 mm (1 to 2 inches) thick. The cover (410) should be both flexible and stretchable, to allow for the greatest possible independent depression and extension of the telescoping columns (105). In general, the smaller the diameter and spacing of the columns (105), the thinner the cover (410) need be to provide comfort. In applications supporting inanimate objects, no cover (410) may be needed.

The reader will see that the modules (290) of the preferred embodiment may be assembled to form supports, mattresses, or beds of predetermined sizes, simply by using more or fewer modules (290) connected in different configurations.

Figure 8:
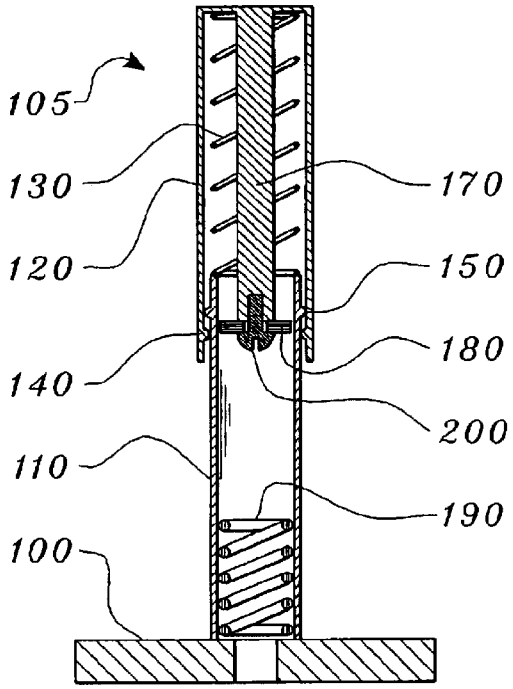
FIG. 8 is a cross-section of another embodiment of the telescoping column.
Figure 9:
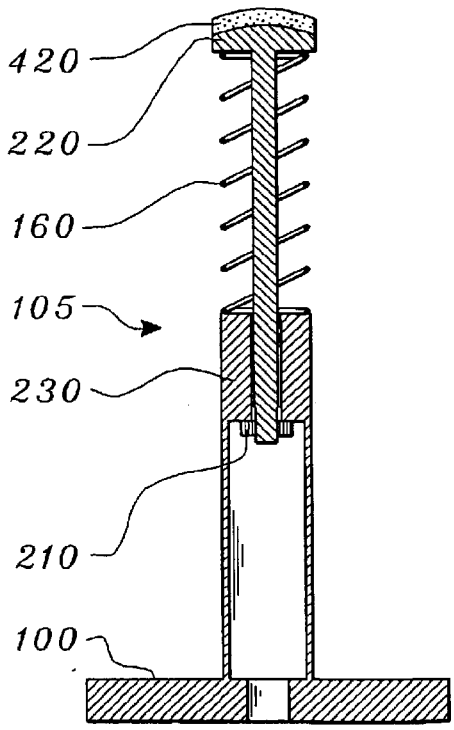
FIG. 9 is a cross-section of another embodiment of the telescoping column.
Figure 10:
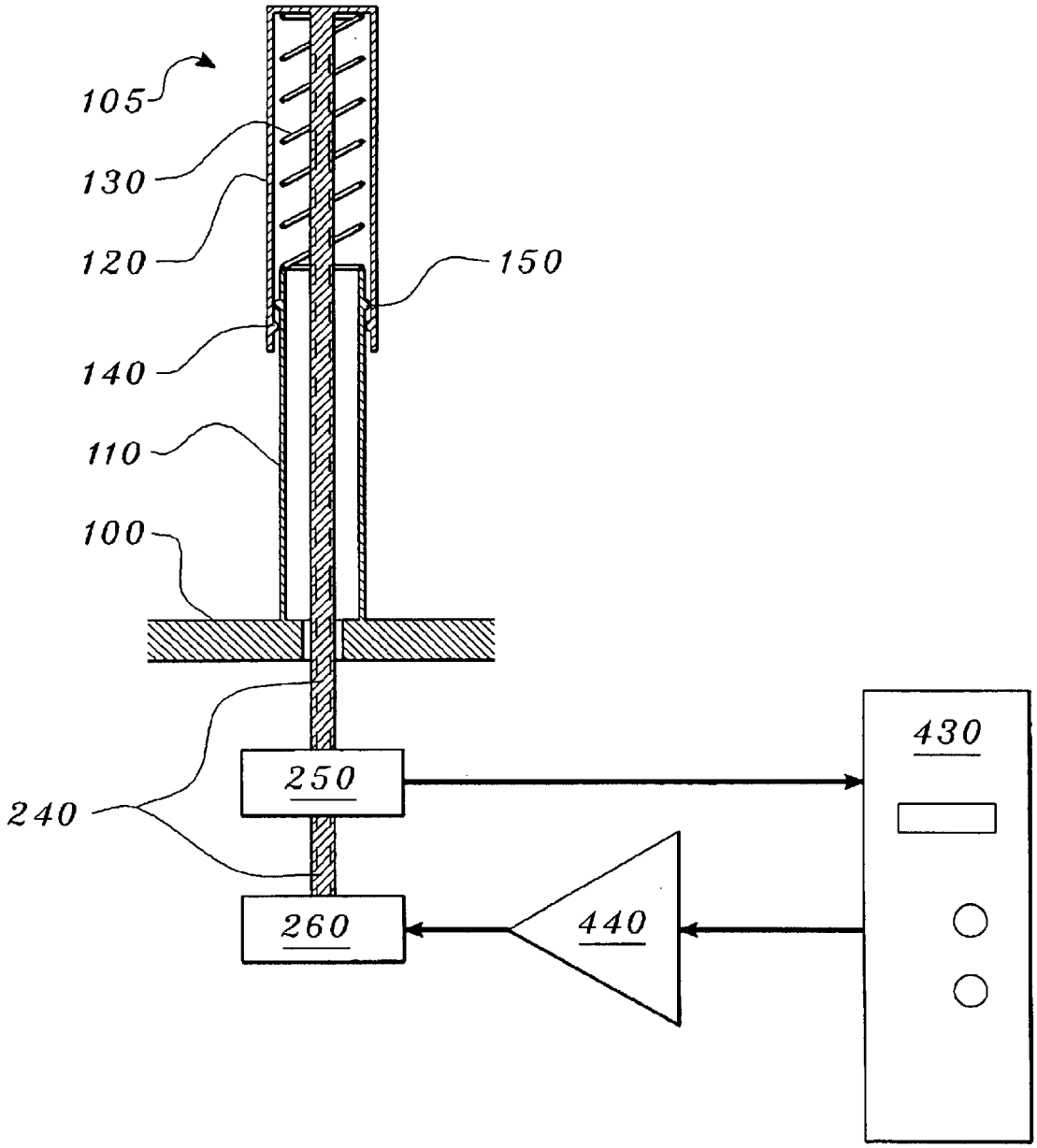
FIG. 10 is a cross-section of another embodiment of the telescoping column, showing a linear position sensor and an actuator connected to the upper section of the column.

FIGS. 8 through 10 show alternative embodiments of the telescoping columns (105). In FIG. 8, an auxiliary spring (190) is located in the lower section (110) and a coaxial push rod (170) formed in the upper section (120) passes into the lower section (110). The push rod (170) has a thrust washer (180) held by a mounting screw (200). The thrust washer (180) will engage the auxiliary spring (190), which thus provides added force for extension of the telescoping column (105) under heavy loads and prevents bottoming-out of the column (105). The auxiliary spring (190) may also be mounted external to the lower section (110) and engage the upper section (120) of the telescoping column (105), as shown in FIGS. 3 and 4. Any equivalent for a spring may be used for the auxiliary spring (190), such as those discussed above for the means for extension.

FIG. 9 depicts a telescoping column (105) where the upper section (120) is replaced by a coaxial rod (220) and the lower section (110) is replaced by an alternative lower section (230). A spring (160) is disposed between the upper head of the rod (220) and the top of the alternative lower section (230) to urge the two parts apart. In the drawing, a limit washer (210) prevents the rod (220) from moving past the base (100). Of course, an auxiliary spring (190), may be placed in the alternative lower section (230) as shown in FIG. 8. A cushion (420) may be placed on top of the coaxial rod (220).

FIG. 10 shows an alternative embodiment where a coaxial actuator rod (240) connected to the upper section (120) extends through the base (100) and operates a linear position transducer (250), such as a potentiometer or servo motor, to produce a signal proportional to the displacement of the actuator rod (240). From this signal, the velocity and acceleration of the actuator rod (240) may be calculated by conventional means, such as by a computer programmed to calculate velocity as $dy/dt$, and acceleration as $d^2y/dt^2$, where "y" represents the measured displacement of the actuator rod (240). The actuator rod (240) is further connected to an actuator (260) capable of forcing the actuator rod (240), and thus the upper section (120), to move up or down in response to an externally-applied signal. The actuator (260) may be an electric servo motor, or a hydraulic or pneumatic actuator. This capability of sensing the position of all of the telescoping columns (105) in an assembled support system, as well as moving them up or down in response to a signal, provides several novel methods of operation.

For example, the telescoping columns (105) in this embodiment could be programmed to provide greater or lesser support at different parts of the plane of support; or, the resistance to compression of the telescoping columns (105) could be programmed to follow some non-linear function, using negative feedback from the linear position transducers (250). Further, the actuators (260) could be programmed to move so as to massage or stimulate different parts of a human body. Such techniques could greatly alleviate the problem of pressure sores, common with conventional support methods. The output of the multiple linear position transducers (250) may be used to construct a three-dimensional picture of the supporting surface for a given body, statically, or in the time domain, along with information on the weight distribution of the body.

In FIG. 10, the output signal from the linear position transducer (250) is received by a programmed, general-purpose computer (430). Such a computer (430) will typically have an input port, random-access-memory, a central-processing unit, a mass-storage device, such as a hard drive, and an output port. Such computers may have a monitor or other graphical display suitable for display of calculated parameters, such as the weight distribution upon a particular planar surface defined by one of the described embodiments. Also, it is conventional to receive transducer signals via an analog-to-digital converter board in the computer, so that digital data corresponding the output of the linear-position transducer (250) will be available for manipulation by the programmed computer (430).

In FIG. 10, the computer (430) data bus drives a servo amplifier (440) that drives the actuator (260). Using conventional methods, the computer (430) could be programmed in novel ways to command the actuators (260) to raise, lower, or rotate an arbitrarily-shaped body relative to the plane of support, for viewing, scanning, or machining operations. The size, shape, and mass of such a body will determine the selection of parameters for the size and spacing of the telescoping columns (105), as discussed above.

Although I have described the invention in terms of specific embodiments, I anticipate that alterations and modifications of it will no doubt become apparent to those skilled in the art. I therefore intend that the following claims be interpreted as covering all such alterations and modifications as fall within the scope of the invention.

I claim:

1. A support system comprising:

a plurality of columns; the columns having first and second ends; the columns further comprising:

at least two telescoping sections slidably engaging one another;

where one of the telescoping sections is an upper section, and a second telescoping section is a lower section, and further comprising:

a push rod internal to the upper section and disposed coaxially therein; the push rod extending into the lower section;

an auxiliary spring disposed inside the lower section; the auxiliary spring engaging the push rod when the actuator is sufficiently compressed; and, at least one actuator disposed between the telescoping sections; the actuator urging the first and second ends of the columns apart; the actuator having a limit of extension;

a base; the columns connected to the base at their first ends; the second ends of the columns defining a plane of support when the actuator is at the limit of its extension; and, the second ends of the columns moveable perpendicular to the plans of support independently of one another.

2. The support system of claim 1 where the actuator is an electric actuator.

3. The support system of claim 1 where the actuator is a hydraulic actuator.

4. The support system of claim 1 where the actuator is a pneumatic actuator.

5. The support system of claim 1 wherein the lower section receives the push rod in slidable engagement.

6. The support system of claim 1 where the actuator is a spring.

7. A support system comprising an array of detachable modules, each module further comprising:

a plurality of columns; the columns having first and second ends; the columns further comprising:

at least two telescoping sections slidably engaging one another;

at least one means for extension disposed between the telescoping sections; the means for extension urging the first and second ends of the columns apart; the means for extension having a limit of extension;

a base; the columns connected to the base at their first ends; the second ends of the columns defining a plane of support when the means for extension are at the limit of their extension; and, the second ends of the columns moveable perpendicular to the plane of support independently of one another.

8. The support system of claim 7 where the means for extension is a spring.

9. The support system of claim 7 where the means for extension is an electric actuator.

10. The support system of claim 7 where the means for extension is a hydraulic actuator.

11. The support system of claim 7 where the means for extension is a pneumatic actuator.

12. The support system of claim 7 where one of the telescoping sections is an upper section, and a second telescoping section is a lower section; the support system further comprising an auxiliary spring; the auxiliary spring engaging the upper section when the means for extension is sufficiently compressed.

13. The support system of claim 7 where one of the telescoping sections is an upper section,, and a second telescoping section is a lower section, and further comprising:

a push rod internal to the upper section and disposed coaxially therein; the push rod extending into the lower section;

an auxiliary spring disposed inside the lower section; the auxiliary spring engaging the push rod when the means for extension is sufficiently compressed.

14. The support system of claim 7 where one of the telescoping sections is an upper section, and a second telescoping section is a lower section; the upper section comprising a push rod coaxial with the lower section; the lower section receiving the push rod in slidable engagement.

15. A support system comprising:

a plurality of columns; the columns having first and second ends; the columns further comprising:

at least two telescoping sections slidably engaging one another;

at least one means for extension disposed between the telescoping sections; the means for extension urging the first and second ends of the columns apart the means for extension having a limit of extension; the means for extension further comprising:

an actuator rod; the actuator rod connected to the first end of the column;

an actuator; the actuator operable to move the actuator rod relative to the second end of the column; and, a base; the columns connected to the base at their first ends; the second ends of the columns defining a plane of support when the means for extension are at the limit of their extension; and, the second ends of the columns moveable perpendicular to the plane of support independently of one another.

16. The support system of claim 15 further comprising a linear position transducer operably connected to the actuator rod, for generating a signal proportional to the displacement of the actuator rod.

17. The support system of claim 16 further comprising:

a general purpose computer, the computer receiving the signal from the linear position transducer; the computer programmed to generate a pre-determined actuator signal in response to the displacement of the actuator rod;

a servo amplifier operably connected to the computer and the actuator, for driving the actuator according to the generated actuator signal.

* * * * *

UNITED STATES PATENT AND TRADEMARK OFFICE

CERTIFICATE OF CORRECTION

PATENT NO. : 6,742,202 B2
DATED : June 1, 2004
INVENTOR(S) : B. Thomas Jones

It is certified that error appears in the above-identified patent and that said Letters Patent is hereby corrected as shown below:

Column 7,
Line 4, the word “plans” should be -- plane --.

Column 8,
Line 20, the phrase “apart the” should be -- apart; the --

Signed and Sealed this

Fifteenth Day of February, 2005

JON W. DUDAS
*Director of the United States Patent and Trademark Office*